US011623775B1

(12) United States Patent
Vaughn

(10) Patent No.: US 11,623,775 B1
(45) Date of Patent: Apr. 11, 2023

(54) MULTIPLE STRAPPING DEVICE

(71) Applicant: Mark A. Vaughn, Neosho, MO (US)

(72) Inventor: Mark A. Vaughn, Neosho, MO (US)

(73) Assignee: Accent Wire Holdings LLC, Tomball, TX (US)

( * ) Notice: Subject to any disclaimer, the term of this patent is extended or adjusted under 35 U.S.C. 154(b) by 0 days.

(21) Appl. No.: 17/672,173

(22) Filed: Feb. 15, 2022

(51) Int. Cl.
*B65B 13/06* (2006.01)
*B65B 27/12* (2006.01)
*B30B 9/30* (2006.01)

(52) U.S. Cl.
CPC ..... *B65B 13/06* (2013.01); *B30B 9/3003* (2013.01); *B65B 27/12* (2013.01)

(58) Field of Classification Search
CPC ..... B65B 13/06; B65B 13/08; B65B 13/12; B65B 13/24; B65B 13/28; B65B 13/30; B65B 13/32; B65B 27/12; B65B 2210/02; B30B 9/3003
USPC ..... 100/26
See application file for complete search history.

(56) References Cited

U.S. PATENT DOCUMENTS 3,224,363 A 12/1965 Talbot
3,528,364 A 9/1970 Freund
3,613,557 A * 10/1971 Coleman ..... B65B 13/06 100/26
3,929,062 A 12/1975 Thompson
3,999,476 A 12/1976 Thompson
4,520,720 A 6/1985 Urban et al.
4,788,901 A 12/1988 Klinner et al.
5,247,880 A 9/1993 Robbins
5,247,881 A 9/1993 Rosser et al.
5,317,965 A 6/1994 Wildes et al.
5,379,687 A 1/1995 Moseley
5,540,144 A 7/1996 Schrag et al.
5,704,283 A 1/1998 Wiedel
6,829,877 B2 12/2004 Daniel et al.
7,085,625 B2 8/2006 Timothy et al.
7,127,985 B2 10/2006 Standlee
7,127,986 B2 10/2006 Daniel et al.
7,389,723 B1 6/2008 Bullington
7,497,158 B2 3/2009 Daniel et al.
7,690,297 B1 4/2010 Sagen et al.
7,841,272 B2 11/2010 Actis et al.
9,278,772 B2 3/2016 Vaughn et al.
2004/0200191 A1* 10/2004 Armstrong ..... B65B 13/06 53/399
2007/0007300 A1 1/2007 Cranston, III et al.
2009/0223388 A1* 9/2009 Doyle ..... B65B 13/06 100/1
2013/0180416 A1 7/2013 Stein et al.

* cited by examiner

*Primary Examiner* — Jimmy T Nguyen
(74) *Attorney, Agent, or Firm* — Stephens Juren PLLC; Matthew C Juren; Ira P Domnitz

(57) ABSTRACT

A multiple strapping device that provides an uninterrupted ejection cycle for a bale while at the same time strategically placing the straps, or wire ties, onto the bale, through use of a series of corkscrews which hold the straps or wire ties and advance the strap, or wire ties, as the corkscrew is rotated therein releasing the strap, or wire ties, onto the bale.

18 Claims, 15 Drawing Sheets

MULTIPLE STRAPPING DEVICE

TECHNICAL FIELD

Embodiments of the present invention relate to a multi-strapping machine which can be attached to a wire tying system, a plastic strapping system, or a combination strapping machine including a wire tying system and a plastic tying system. Embodiments of the present invention relate to strapping a bale with multiple straps with an uninterrupted bale ejection cycle. Some embodiments of the present invention relate to a combination strapping machine for baling recycled materials, having a common frame coupled to both a wire strapping system for applying a wire tying medium and a plastic strapping system for applying a plastic tying medium. The combination wire tying system will be used for exemplary purposes, although, as noted, the multisampling machine can be used on a plastic strapper or wire tying machine.

BACKGROUND OF THE INVENTION

Traditional bulk-material baling machines incorporate a tying system for wrapping and/or securing the baled material, such as a wire tying system. In forming bales of compressible materials, it is important to surround the baled material with a tying medium having sufficient strength to maintain the form of the compressed bale for shipping and/or storage. At the same time, the tying medium used to secure a bale must be adequately tensioned by the tying system, as well as securely knotted and/or tied around the bale. As the characteristics of each type of tying medium are unique, a single baling machine typically uses a single tying medium with a single tying system coupled to the machine. As such, a typical baling machine is not able to vary the types of tying media applied to different portions of a single bale.

In the baling industry, the wire/plastic tying process has always been the bottleneck of the baling operation with regards to speed and throughput. Previously in the industry, the bale must be incrementally ejected so that each strap can be placed in a specific location to contain the bale as it expands. In such instances, each type of recycling/waste material that is being baled will have a preset number of straps as well as strap placement location for safety and efficiency. In such instances, a strap can take about 10 seconds of pause time during the bale ejection process. In some instances, some users will run up to 10 straps per bale while others may only use 5 straps. In several embodiments, the present invention can reduce the amount of time that it takes to fully eject a bale, thus increasing the throughput of material being baled.

In some embodiments, the present invention provides an uninterrupted ejection cycle for a bale while at the same time strategically placing the straps onto the bale. In some embodiments, this can include changing the number of straps that are placed onto the bale per different material being baled. In several embodiments, as the baler is making a bale using the process of compaction, the wire tier will be pre-making the straps and placing them in the valley of the corkscrews on a modified baling chute.

In several embodiments of the present invention, the delivery method of placing these straps is determined by the speed of the motor that is coupled to the corkscrews. In several embodiments of the present invention, the speed of the motor coupled to the corkscrew is determined by the linear speed of the ejector on the baler as well as the programmed placement of the strap position and quantity. In several embodiments, an additional design would allow the bale chamber to expand in the case of an oversized bale, which can be common in the art of baling. In such a case, the pre-made straps would be driven off the chamber and discarded so that the chamber can be mechanically widened for the oversized bale.

In several embodiments, the strap materials can be formed of metal, plastic, or other materials as known in the industry. In several embodiments, the corkscrews can be driven by a hydraulic, electric, air, etc. motor with the rotations being continuously monitored and driven by a controller. In several embodiments, each bale will have a predetermined recipe for dimensional placement as well as number of straps. In several embodiments, each corkscrew can be driven independently with multiple motors or through a connected chain/belt/shaft driven device. In several embodiments of the present invention, wire or plastic straps can be strapped to a bale in any variety of combinations, at the user's discretion. In many embodiments of the present invention, the bale chamber can be formed in various dimensions.

In some embodiments, the present invention is a bale strapper for strapping of multiple straps on a bale comprising: a bale chute with a hollow interior and an exterior with edges; multiple corkscrews, with central axis, arranged around the exterior edges of said bale chute; a motor; a drive belt in mechanical communication with said multiple corkscrews; said motor is in mechanical communication with said drive belt; wherein when said motor is activated, said drive belt rotates about said motor causing said corkscrews to rotate about their central axis. In some embodiments, said bale strapper is mechanically attached to a combination strapping machine for tying wire or plastic straps. In some embodiments, said combination machine can form a plastic strap and extrude it onto a valley of each of said multiple corkscrews. In some embodiments, the rotation of said corkscrews will release said plastic strap onto a bale. In some embodiments, said combination machine can form a wire tie and extrude it onto a valley of each of said multiple corkscrews. In some embodiments, the rotation of said corkscrews will release said wire tie onto a bale. In some embodiments, said bale strapper is mechanically attached to a wire tying machine. In some embodiments, said combination machine can form a wire tie and extrude it onto a valley of each of said multiple corkscrews. In some embodiments, the rotation of said corkscrews will release said wire tie onto a bale. In some embodiments, said bale strapper is mechanically attached to a plastic strapping machine. In some embodiments, said combination machine can form a plastic strap and extrude it onto a valley of each of said multiple corkscrews. In some embodiments, the rotation of said corkscrews will release said plastic tie onto a bale.

Additional objects, advantages, and novel features of the invention will be set forth in part in the description that follows, and in part will become apparent to those skilled in the art upon examination of the following or may be learned by practice of the invention.

BRIEF DESCRIPTION OF SEVERAL VIEWS OF THE DRAWINGS

The present invention is described in detail below with reference to the attached drawing figures, wherein.

DETAILED DESCRIPTION OF THE INVENTION

In one embodiment of the invention, a combination strapping machine for use on a baler is provided. The strapping machine may include a strapping machine frame having a common track perimeter and a top side, a right side, a left side, or a bottom side; a plastic tying system coupled to one of the top side, the right side, the left side, or the bottom side of the strapping machine frame, the plastic tying system having a plastic track, wherein the plastic tying system is configured to apply a plastic strap to a baled material, the plastic tying system may include the plastic closing mechanism (such as a welder); and a wire tying system coupled to one of the top side, the right side, the left side, or the bottom side of the strapping machine frame, the wire tying system having a wire track, wherein the wire tying system is configured to apply a wire strap to the baled material, the wire tying system may include the wire closing mechanism (such as a knotter), wherein the wire track is adjacent the plastic track, and further wherein the plastic closing mechanism may be spaced apart from the wire closing mechanism.

In some embodiments, the present invention provides an uninterrupted ejection cycle for a bale while at the same time strategically placing the straps onto the bale. In some embodiments, this can include changing the number of straps that are placed onto the bale per different material being baled. In several embodiments, as the baler is making a bale using the process of compaction, the wire tier will be pre-making the straps and placing them in the valley of each the corkscrews on a modified baling chute.

In several embodiments of the present invention, the delivery method of placing these straps is determined by the speed of the motor that is coupled to the corkscrews. In several embodiments of the present invention, the speed of the motor coupled to the corkscrew is determined by the linear speed of the ejector on the baler as well as the programmed placement of the strap position and quantity. In several embodiments, an additional design would allow the bale chamber to expand in the case of an oversized bale, which can be common in the art of baling. In such a case, the pre-made straps would be driven off the chamber and discarded so that the chamber can be mechanically widened for the oversized bale.

In several embodiments, the strap materials can be formed of metal, plastic, or other materials as known in the industry. In several embodiments, the corkscrews can be driven by a hydraulic, electric, air, etc. motor with the rotations being continuously monitored and driven by a controller. In several embodiments, each bale will have a predetermined set of variables for dimensional placement as well as number of straps. In several embodiments, each corkscrew can be driven independently with multiple motors or through a connected chain/belt/shaft driven device.

Figure 1:
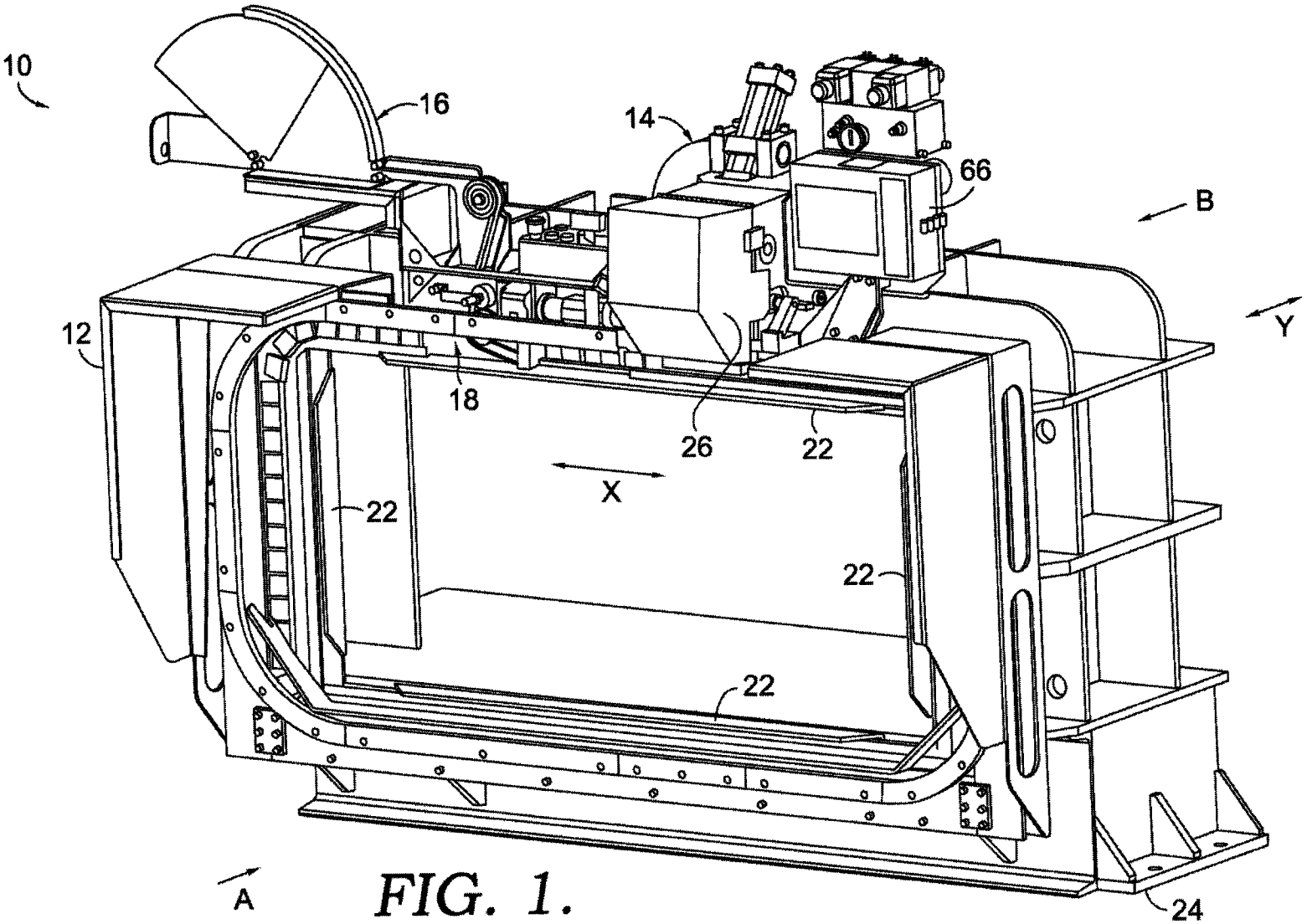
FIG. 1 is a front perspective view of an exemplary strapping machine for bulk-material baling.

With reference now to FIG. 1, as shown is an exemplar of a strapping machine 10 which may include a strapping machine frame 12 coupled to a wire tying system 14 and a plastic tying system 16. Both the wire tying system 14 and the plastic tying system 16 may be configured to apply a tying medium to a baled material via the common track perimeter 18. As shown in FIG. 1, based on the application of plastic tying medium to a baled material, the common strapping machine includes bloom plates 22 coupled to the strapping machine frame 12. In some embodiments, the common base 24 supports the strapping machine frame 12 having a wire tying system 14 and a plastic tying system 16 on a top surface.

The exemplar strapping machine 10 also includes a knotter assembly 26 of the wire tying system 14. Other exemplars include a knotter assembly 26 for tying a wire strap around a baled material, such as the knotter assembly described in one or more of the following U.S. patent applications: U.S. application Ser. No. 12/717,616, filed Mar. 4, 2010, entitled "Knotter Assembly," now U.S. Pat. No. 8,397,632, issued Mar. 19, 2013; U.S. application Ser. No. 13/220,798, filed Aug. 30, 2011, entitled "Knotter Assembly,"; and U.S. application Ser. No. 13/753,188, filed Jan. 29, 2013, entitled "Method For Removing A Twist-Module Sub-Assembly In A Knotter Assembly," the disclosure of each of which is hereby incorporated by reference in its entirety.

Additionally, as shown in FIG. 1, the strapping machine 10 may include a control system 66 coupled directly or indirectly to the strapping machine 10. For example, the strapping machine 10, having both a wire tying system 14 and a plastic tying system 16, may include a common control system 66 configured to control both tying media, such as the control system described in U.S. Application No. 61/873,662, filed Sep. 4, 2013, entitled "Control User Interface For Tying System," the disclosure of which is hereby incorporated by reference in its entirety.

As further depicted in FIG. 1, the strapping machine 10 includes a front side A and a rear side B, oriented with respect to a y-axis. As shown, the wire tying system 14 is configured towards the front side A of the strapping machine frame 12, while the plastic tying system is configured towards the rear side B of the strapping machine frame 12. Additionally, in some embodiments, wire tying system 14 and plastic tying system 16 may be oriented along a common x-axis, on a top surface of the strapping machine 10. In other embodiments, the wire tying system 14, the plastic tying system 16, or both the wire tying system 14 and the plastic tying system 16 may be positioned on a side surface, a bottom surface, a top surface of the strapping machine 10, or a combination of multiple different surfaces and/or sides of the strapping machine 10. For example, as depicted in the front view of FIG. 3C, the wire tying system 14 and knotter assembly 26 is positioned on a side surface of the strapping machine 10, and the wire tying system 16 is positioned on a top surface of the strapping machine 10.

Figure 2A:
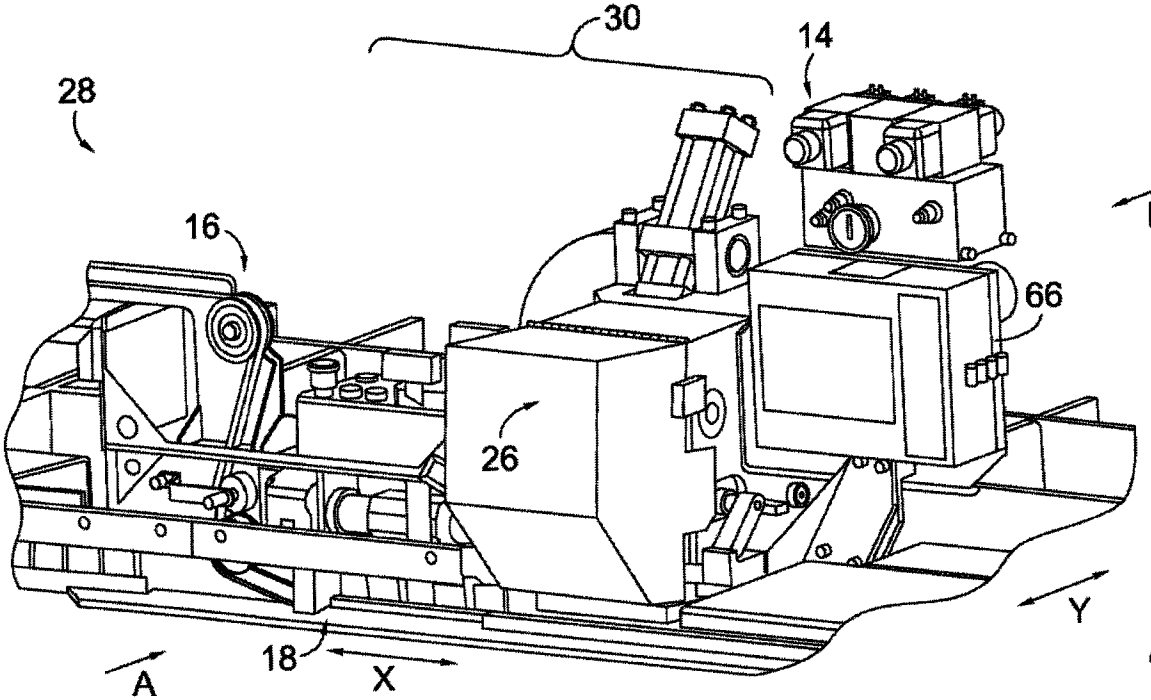
FIG. 2A is an enlarged, front perspective view of the strapping machine of FIG. 1.

As further shown in the enlarged, perspective view 28 of FIG. 2A, the tying portion 30 may be located on the top of the strapping machine 10 and may include at least a portion of the wire tying system 14 and at least a portion of the plastic tying system 16. In other embodiments, there may be more than one tying portion 30. For example, as depicted in FIG. 3C, there is a tying portion 30 associated with the top of the strapping machine 10 that includes a portion of the plastic tying system 16 and a second tying portion 31 associated with the side of the strapping machine 10 that includes a portion of the wire tying system 14.

Figure 2B:
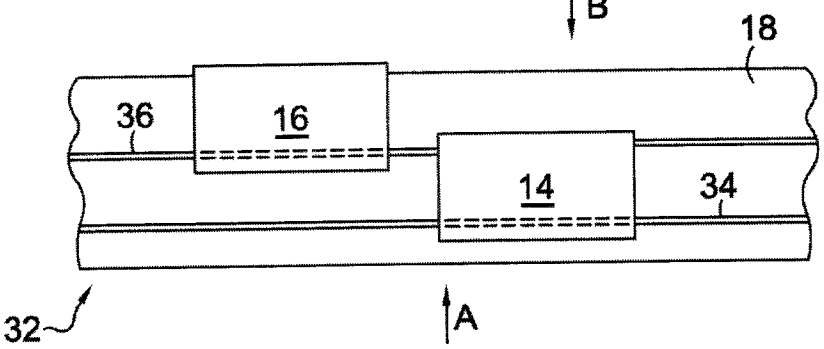
FIG. 2B is a top, schematic diagram of the components of an exemplary strapping machine.

As shown, a portion of each of the wire tying system 14 and the plastic tying system 16 may be offset with respect to the common track perimeter 18, enabling a wire track to be positioned adjacent a plastic track along a common track perimeter 18. Accordingly, as shown in the top, schematic diagram 32 of FIG. 2B, the common track perimeter 18 may be configured to secure both a wire strap 34 (from a wire tying system 14) and a plastic strap 36 (from a plastic tying system 16). In one embodiment, a common track perimeter 18 may refer to a single channel surrounding a baled material that receives both a first and a second tying material. In another embodiment, a common track perimeter 18 may refer to a multi-channel feature surrounding a baled material that receives a first tying material via a first channel and receives a second tying material via a second channel adjacent and/or parallel to the first channel.

Figure 3A:
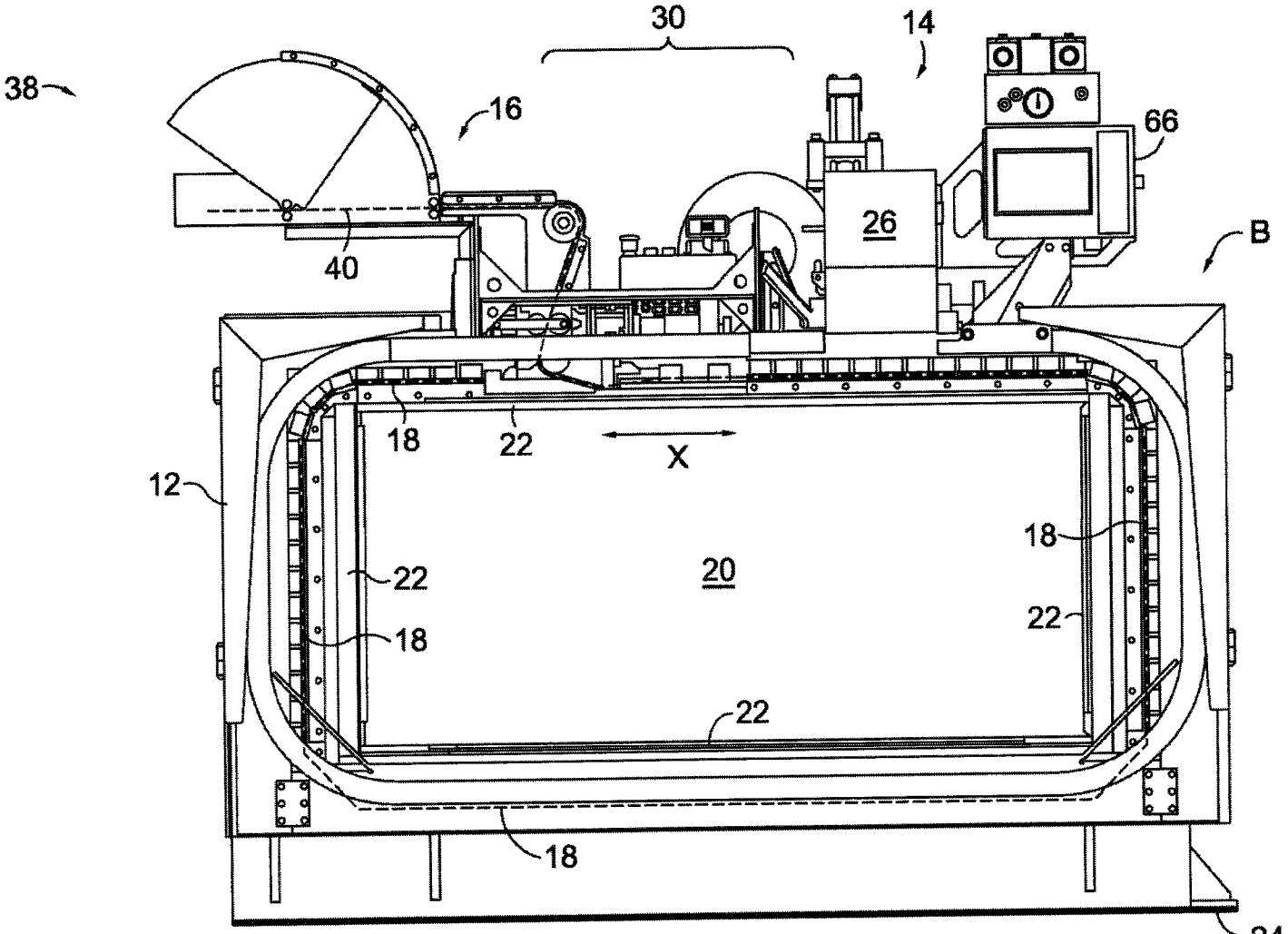
FIG. 3A is a front view of an exemplary strapping machine applying a plastic strap using a plastic tying system.
Figure 3B:
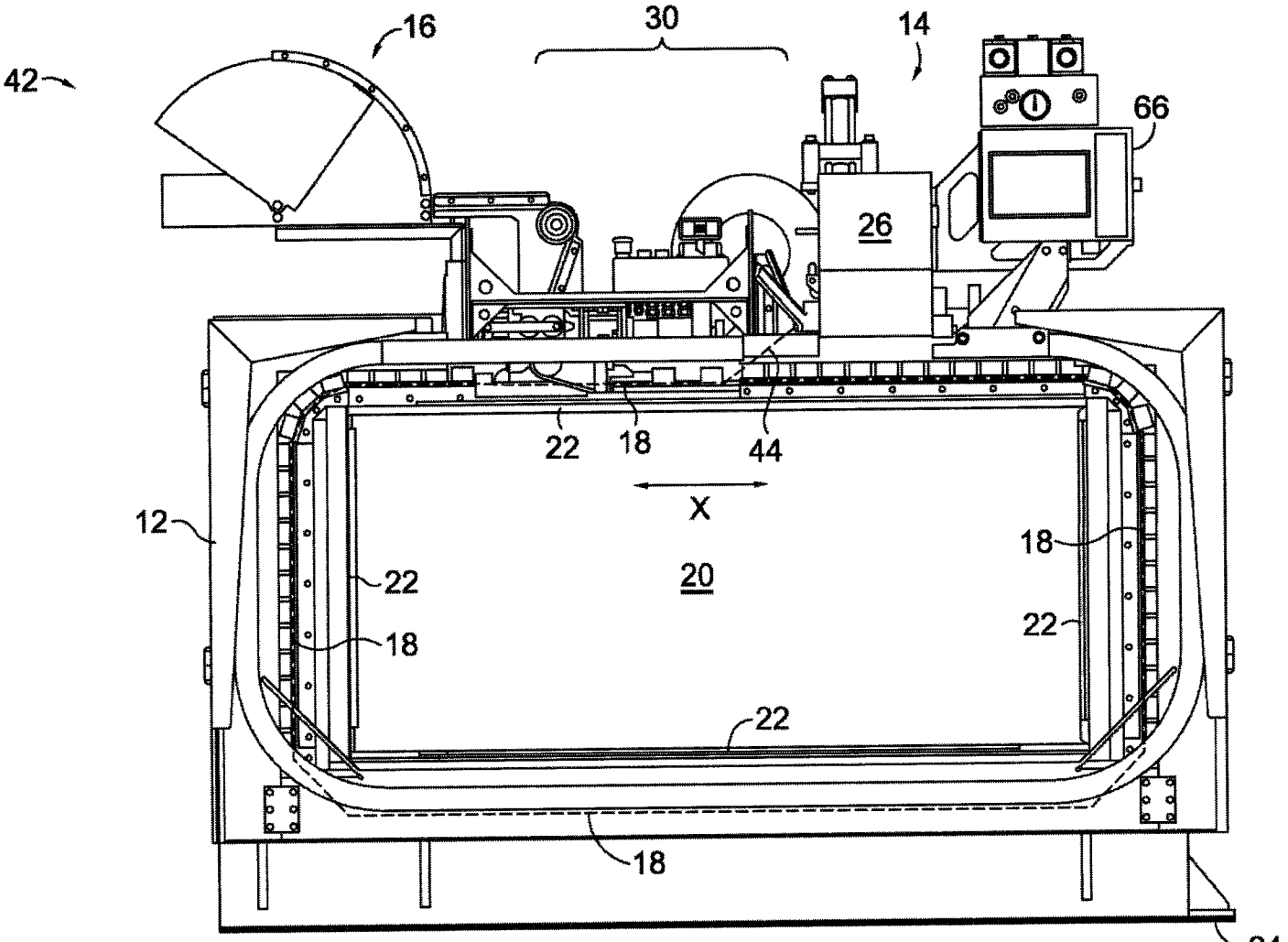
FIG. 3B is a front view of an exemplary strapping machine applying a wire strap using a wire tying system.
Figure 3C:
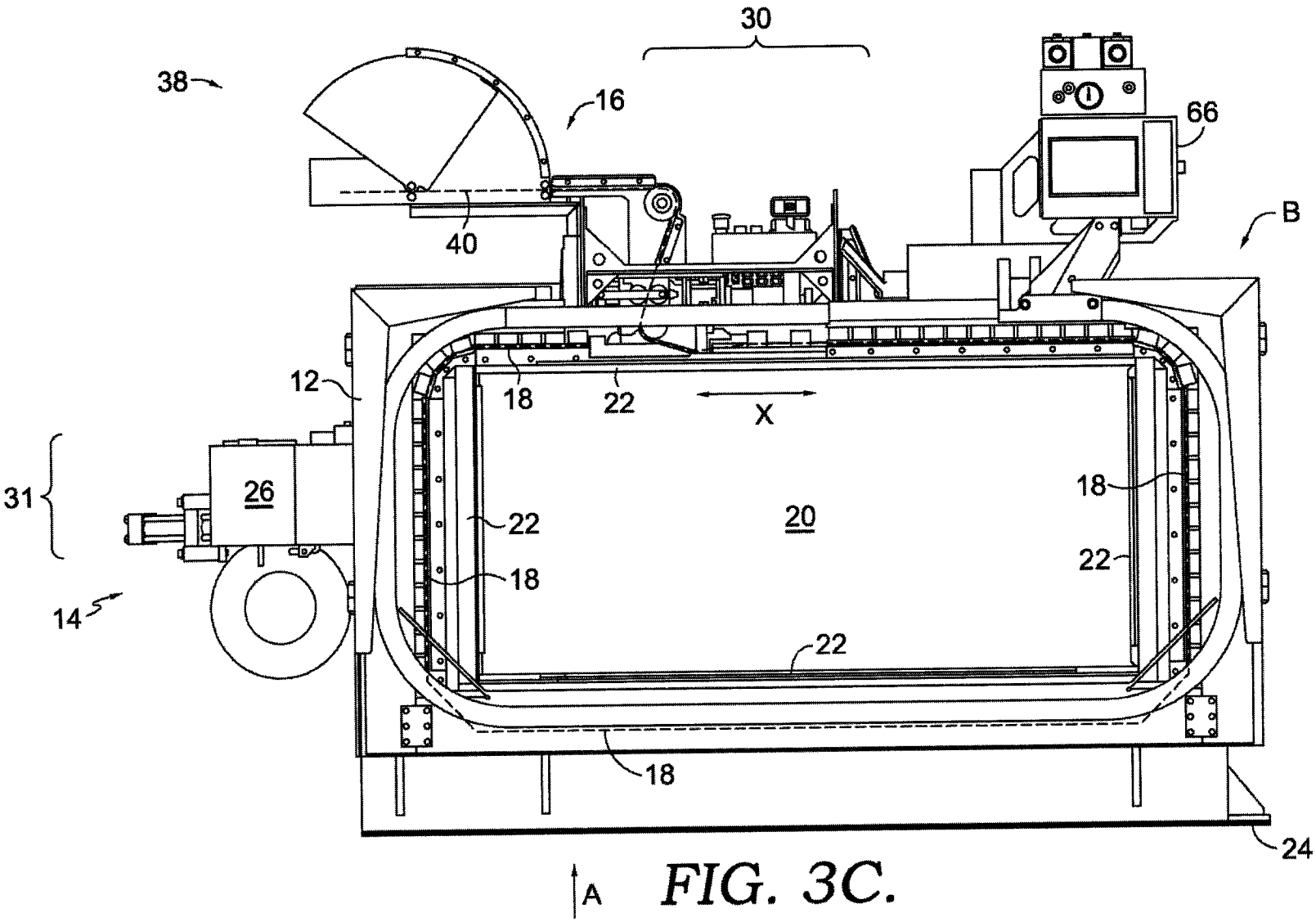
FIG. 3C is a front view of an exemplary strapping machine having a wire tying system located on a side surface of the strapping machine and a plastic tying system located on a top surface of the strapping machine.

Referring next to FIG. 3A, a front view of an exemplary strapping machine 38 depicts the application of a plastic strap 40 around a material based through opening 20, according to one embodiment. In a further embodiment, the plastic strap 40 may be applied using the plastic tying system 16 by travelling along the common track perimeter 18 in a clockwise direction. As shown in FIG. 3B, a front view of an exemplary strapping machine 42 depicts the application of a wire strap 44 around a material baled through opening 20, according to one embodiment. In a further embodiment, the wire strap 44 may be applied using the wire tying system 14 by travelling along the common track perimeter 18 in a counterclockwise direction. As shown in FIG. 3C, a front view of an exemplary strapping machine 38, some embodiments may include the wire tying system 14 and knotter assembly 26 positioned on a side surface of the strapping machine 10 and the plastic tying system 16 positioned on a top surface of the strapping machine 10. Additionally, some embodiments, as shown in FIG. 3C, may include a tying portion 30 associated with the top of the strapping machine 10 that includes a portion of the plastic tying system 16 and a second tying portion 31 associated with the side of the strapping machine 10 that includes a portion of the wire tying system 14.

Figure 4A:
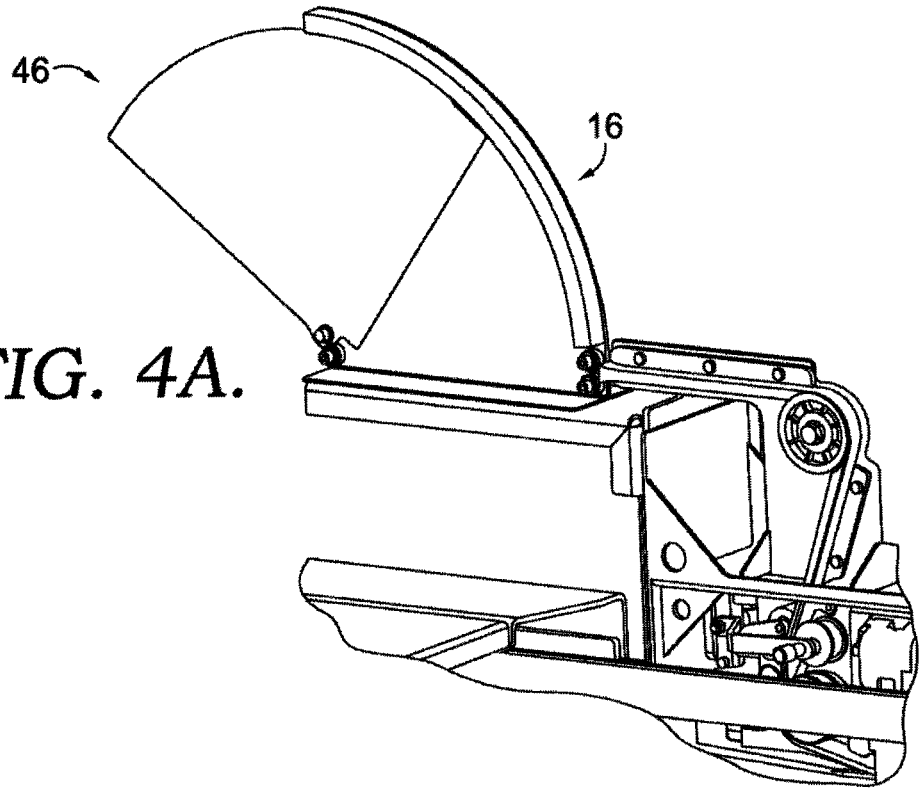
FIG. 4A is an enlarged, perspective view of the plastic tying system of FIG. 1.
Figure 4B:
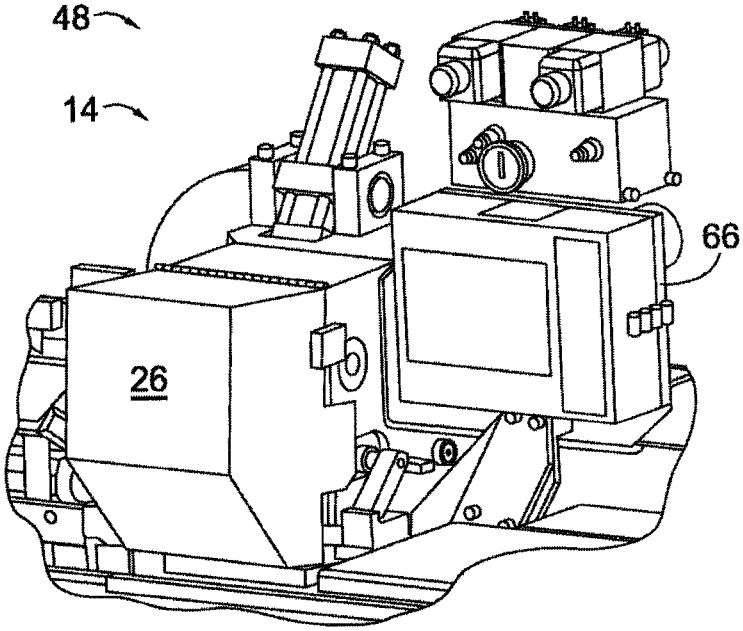
FIG. 4B is an enlarged, perspective view of the wire tying system of FIG. 1.

Turning next to FIG. 4A, an enlarged, perspective view 46 of plastic tying system 16 is depicted according to an embodiment of the invention. In some embodiments, the plastic tying system 16 utilizes a plastic closing mechanism to join a plastic strap around a baled material. In some embodiments, the plastic closing mechanism comprises a thermal welding head for sealing of two portions of the plastic strap together. In other aspects, the plastic closing mechanism comprises a hot knife system. In yet other embodiments, the plastic closing mechanism comprises a friction inducing mechanism, such as a vibrating platen and/or anvil, used to join two portions of the plastic strap together. In still other embodiments, the plastic closing mechanism comprises crimping or buckling two portions of the plastic strap together. It is understood that the plastic closing mechanism may comprise any suitable mechanisms for joining two portions of the plastic strap together to seal the plastic strap around the baled material. In several embodiments, plastic tying system 16 incorporates one tying portion 30. FIG. 4B is an enlarged, perspective view 48 of the wire tying system 14, knotter assembly 26, and control system 66 of FIG. 1 and as discussed throughout this disclosure.

Figure 5:
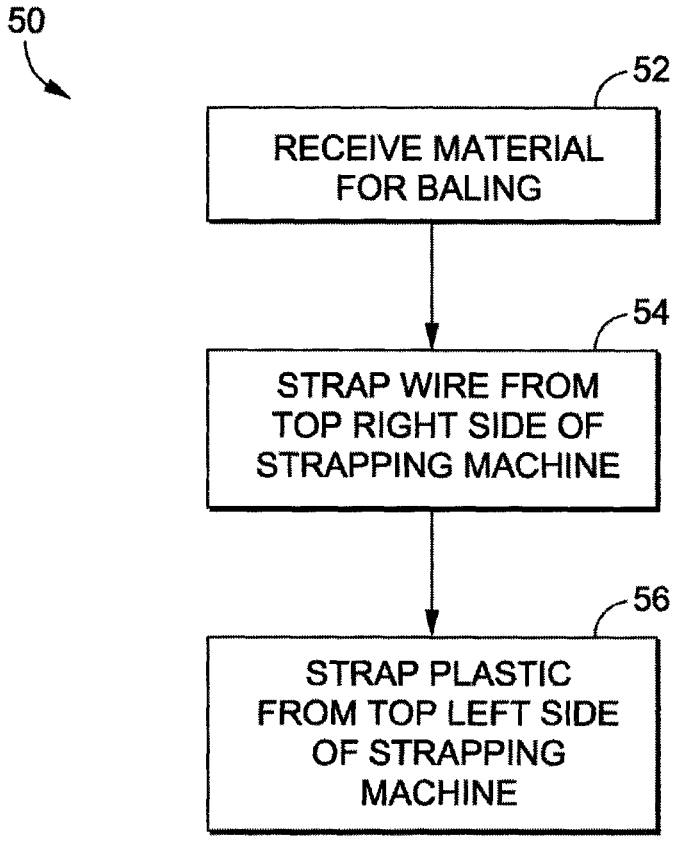
FIG. 5 is a flow diagram of a method of tying a plastic strap and a wire strap using a common strapping machine.

With reference to the flow diagram of FIG. 5, an exemplary method 50 of tying a plastic strap and a wire strap using a common strapping machine is provided. At block 52, a material is received for baling, such as a recycled and/or waste material. At block 54, wire is strapped from a top right side of the strapping machine. In some embodiments, based on strapping the wire from a top right side of the strapping machine, the wire continues through the common track perimeter of the strapping machine in a counterclockwise direction. At block 56, a plastic strap is applied from a top left side of the strapping machine. Accordingly, the plastic strap continues through the common track perimeter of the strapping machine in a clockwise direction, according to embodiments of the invention. It is understood that the wire may be strapped from any side along the strapping machine perimeter and not only from the top right side of the strapping machine. Likewise, it is understood that plastic strap may be applied from any side along the strapping machine perimeter and not only from the top left side.

Figure 6:
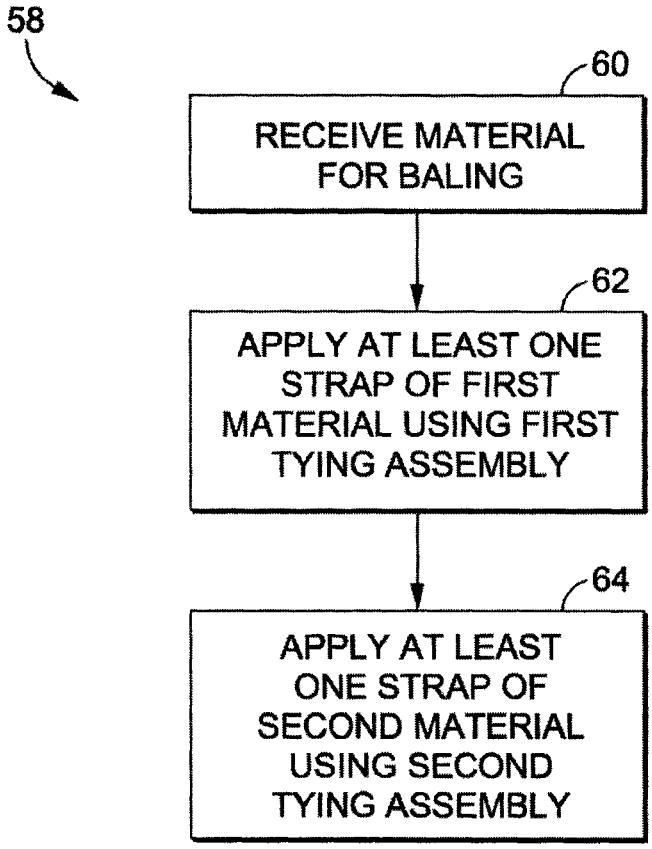
FIG. 6 is a flow diagram of a method of applying a strap of a first material and a strap of a second material using a common strapping machine.

Referring to the flow diagram of FIG. 6, an exemplary method 58 of applying a strap of a first material and a strap of a second material using a common strapping machine is described in accordance with an embodiment of the invention. At block 60, a material for baling is received, such as a recycled and/or waste material. At block 62, at least one strap of a first material is applied to the bale using a first tying assembly. In some embodiments, the first material is applied to the bale in a first direction around the common track perimeter. At block 64, at least one strap of a second material is applied to the bale using a second tying assembly. In some embodiments, the second material is applied to the bale in a second direction around the common track perimeter. In some embodiments, the second direction is opposite the first direction, and the second material and/or tying medium is different than the first material and/or tying medium.

Figure 7:
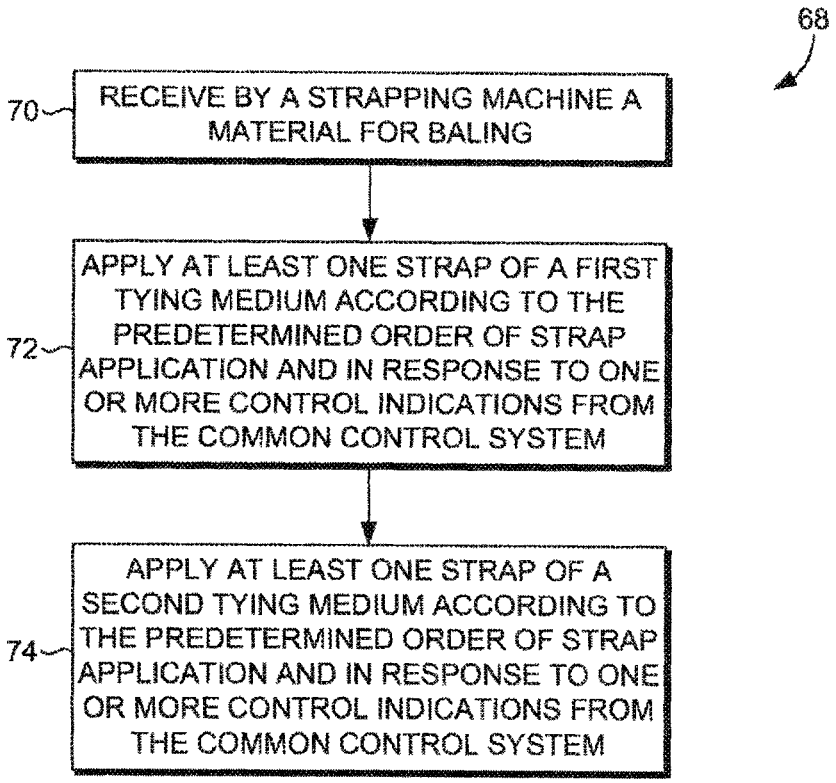
FIG. 7 is a flow diagram of a method for strapping a baled material according to a predetermined order of strap application.

Referring to FIG. 7, in another embodiment, a method 68 of strapping a baled material according to a predetermined order of strap application is provided. In one aspect, the method 68 includes receiving, by a strapping machine, a material for baling, as depicted at block 70. The strapping machine may comprise a first tying assembly, a second tying assembly, and a common control system configured to automatically alternate control indications between the first tying assembly and the second tying assembly. In another aspect, the method 68 includes applying at least one strap of a first tying medium according to the predetermined order of strap application and in response to one or more control indications from the common control system, as depicted in block 72. The at least one strap of the first tying medium may be applied using the first tying assembly coupled to the strapping machine. In another aspect, the method 68 includes applying at least one strap of a second tying medium according to the predetermined order of strap application and in response to one or more control indications from the common control system, as depicted in block 74. The at least one strap of the second tying medium may be applied using the second tying assembly coupled to the strapping machine.

In some embodiments, the first tying medium comprises a plastic tying medium. In other embodiments, the second tying medium comprises a wire tying medium. It is understood that the first and second tying mediums may comprise other suitable material tying mediums (such as polyester) so long as the first tying medium is different from the second tying medium.

In one embodiment, the method 68 may further include advancing the material to be baled to a first position; and upon advancing the material to be baled to the first position, providing a first control indication to the first tying assembly to apply a first strap comprised of the first tying medium to the material to be baled. The method 68 may further include advancing the material to be baled to a second position; and upon advancing the material to be baled to the second position, providing a second control indication to the second tying assembly to apply a second strap comprised of the second tying medium to the material to be baled. The method 68 may further include advancing the material to be baled to a third position; and upon advancing the material to be baled to the third position, providing a third control indication to the first tying assembly to apply a third strap comprised of the first tying medium to the material to be baled.

Further reference to exemplary combination wire tying and plastic strapping can be found, as herein incorporated by reference, in U.S. Pat. Nos. 9,278,772 and 10,351,274.

Figure 8:
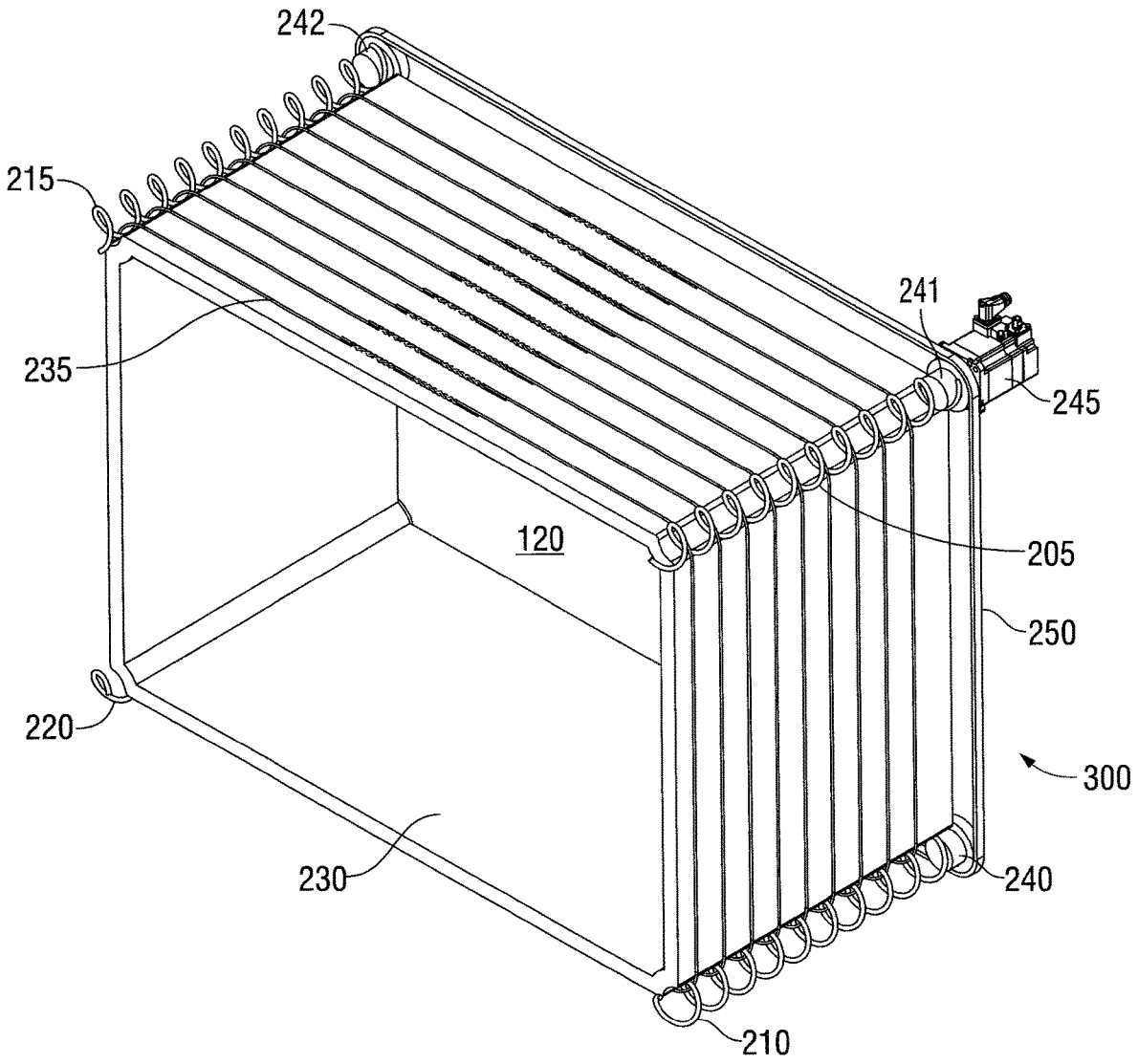
FIG. 8 is a perspective view of one embodiment of the multistrapping invention.

FIG. 8 is a perspective view of the multistrapping embodiment of the present invention. With reference now to FIG. 8, as shown is one embodiment of the multistrapper 300. As shown, multistrapper 300 has an interior 120. Interior 120 can be comprised to be a set dimension or have dimensional variability depending on the size of the bales to be made and/or the end user's needs. In many embodiments, multistrapper 300 can be comprised of metal, plastic or materials as used in the art of baling. Multistrapper 300 also includes bale chamber 230 in which baled materials will progress forward for strapping when the device is in use. In many embodiments of the present invention, the multistrapper 300 can use straps 235 that are entirely plastic straps. In many embodiments of the present invention, the multistrapper 300 can use straps 235 that are entirely wire ties. In several embodiments, the present invention could be attached to preexisting plastic strappers or wire tie machines.

In some embodiments, further illustrated are corkscrews 205, 210, 215, and 220 which are in mechanical communication with the exterior of multistrapper 300. As illustrated in some embodiments, the corkscrews 205, 210, 215, and 220 are securely held onto the multistrapper 300 via straps or ties 235 which encircle the multistrapper 300 and are previously created by a strapping or tying machine, such as the ones disclosed throughout this application. By way of example, as the baler is making a bale using the process of compaction, a wire tier, or plastic strapper, will be pre-making the straps and placing them in a valley of each of the corkscrews as shown. The strap and wire tie creation has been previously disclosed in this application.

In several embodiments of the present invention, the delivery method of placing these straps 235 is determined by the speed of a motor 245 that is coupled to a drive band 250. The speed of the motor 245 is determined by the linear speed of the ejector on the baler as well as the programmed placement position of the strap 235 and quantity of straps. In some embodiments of the present invention, the drive band 250 can rotate about wheels, pulleys, or cogs 240, 241, 242, and or 243 (Not shown in FIG. 8, see FIG. 12). An additional design would allow the bale chamber 120 to expand in the case of an oversized bale, which can be common. In this case, the pre-made straps would be driven off the chamber and discarded so that the chamber can be mechanically widened for the oversized bale. In some embodiments, the corkscrews 205, 210, 215, and 220 can be driven by a hydraulic, electric, air, etc. motor with the rotations being continuously monitored and driven by a controller. Each bale will have a predetermined program for dimensional placement as well as number of straps 235. Each corkscrew 205, 210, 215, and/or 220 can be driven independently with multiple motors or through a connected chain, belt, or shaft driven device.

As shown, in several embodiments, corkscrews 205, 210, 215, and/or 220 may be comprised of metal, plastic, or other hardened materials comprising a corkscrew design or shape. The material comprising the corkscrews should be sufficiently rigid to support tension of the straps as they traverse the length of the corkscrews. It should be appreciated that the rotation of the corkscrews allows for the straps to traverse the length of the corkscrews until the strap is applied to the bale.

Figure 9:
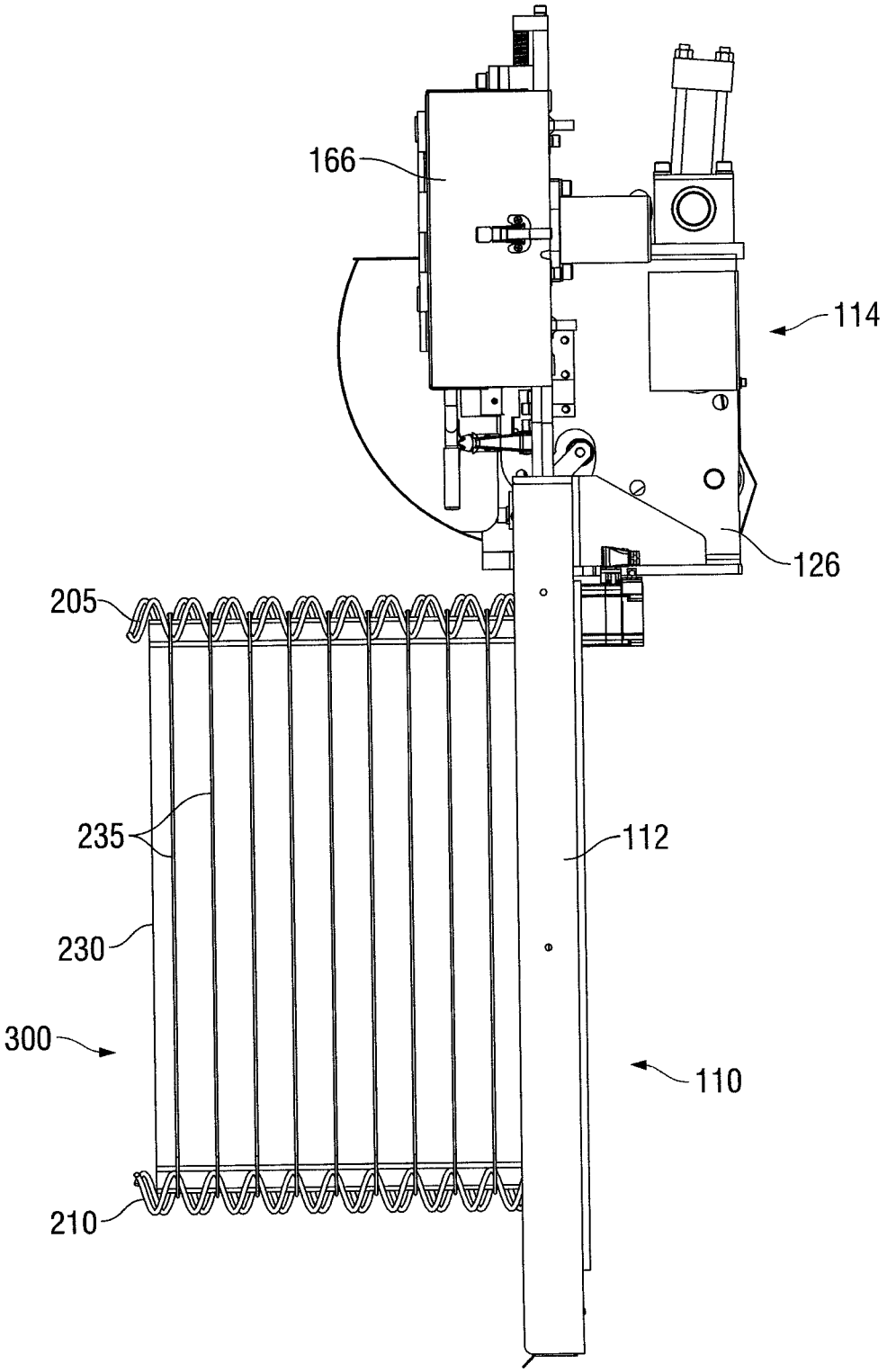
FIG. 9 is a side view of one embodiment of the strapper and multistrapping embodiment of the invention.

FIG. 9 is a side view of the strapper and multistrapping embodiment of the invention in connection, in one embodiment of the invention. With reference now to FIG. 9, an embodiment of a strapping machine 110 may include a strapping machine frame 112. The exemplary strapping machine 110 also includes a knotter assembly 126 such as the knotter assembly described in one or more of the following U.S. patent applications: U.S. application Ser. No. 12/717,616, filed Mar. 4, 2010, entitled "Knotter Assembly,", now U.S. Pat. No. 8,397,632, issued Mar. 19, 2013; U.S. application Ser. No. 13/220,798, filed Aug. 30, 2011, entitled "Knotter Assembly,"; and U.S. application Ser. No. 13/753,188, filed Jan. 29, 2013, entitled "Method For Removing A Twist-Module Sub-Assembly In A Knotter Assembly," the disclosure of each of which is hereby incorporated by reference in its entirety.

Additionally, as shown in FIG. 9, the strapping machine 110 may include a control system 166 coupled directly or indirectly to the strapping machine 110. The controlling system can include changing the number of straps 235 that are placed onto the bale per different material being baled. As the baler is making a bale using the process of compaction, the wire tier will be pre-making the straps and placing them in the valley of the corkscrews 205, 210, 215, and/or 220 as shown. Additionally, as shown in FIG. 9, in some embodiments of the invention is bale chamber 230. Straps 235 can be wire or plastic straps, as disclosed above, that are premade at the discretion of the user. In many embodiments, the wire and/or plastic straps can be in any arrangement or order on the valley of the corkscrews 205, 210, 215, and/or 220.

Figure 10:
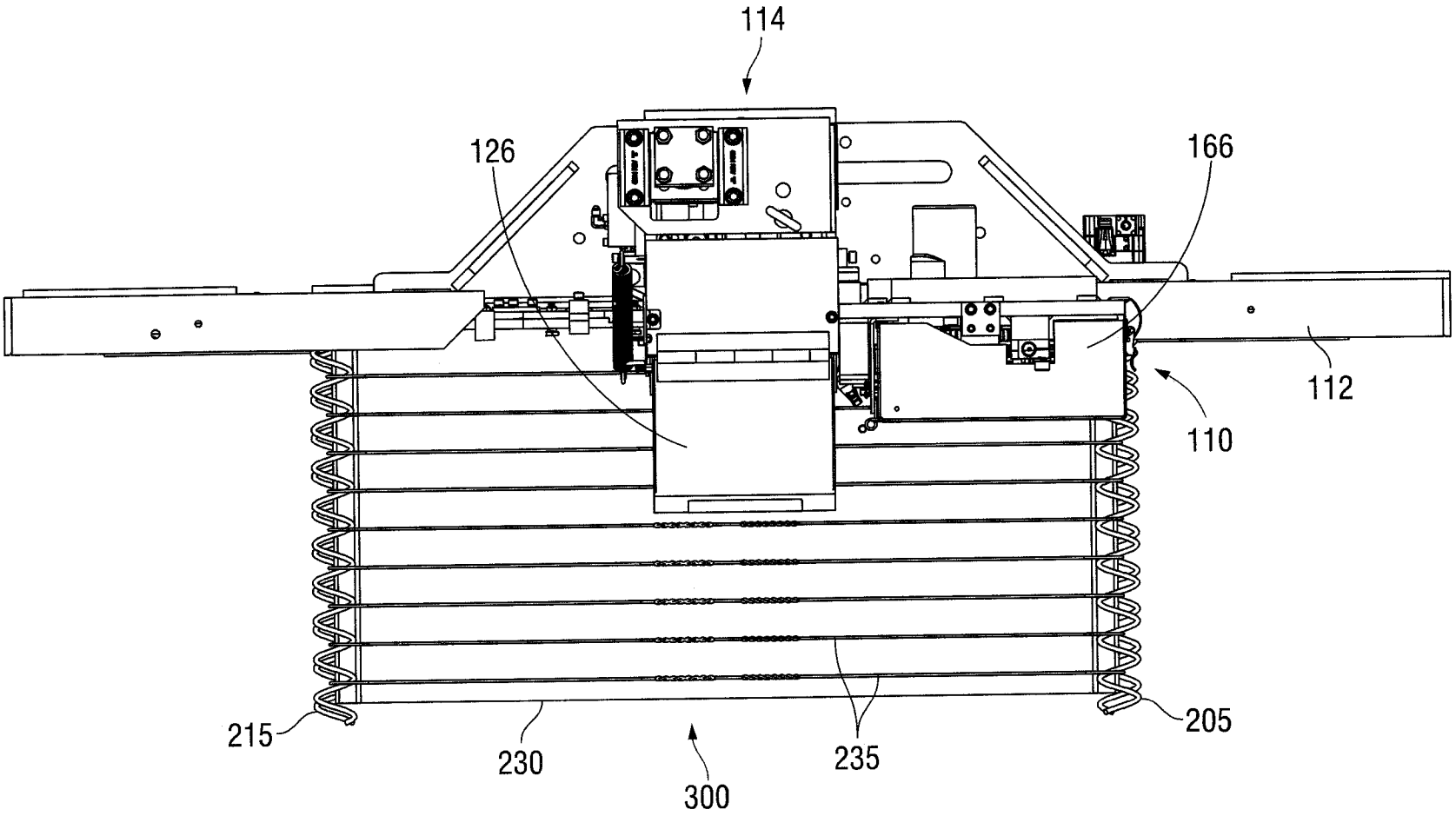
FIG. 10 is a top view of one embodiment of the strapper and multistrapping embodiment of the invention.

FIG. 10 is a top view of one embodiment of the strapper and multistrapping embodiment of the invention. With reference now to FIG. 10, an embodiment of a strapping machine 110 may include a strapping machine frame 112. The exemplary strapping machine 110 also includes a knotter assembly 126.

Additionally, as shown in FIG. 10, in one embodiment of the present invention, the strapping machine 110 may include a control system 166 coupled directly or indirectly to the strapping machine 110. The control system can, by example, change the number of straps 235 that are placed onto the bale per different material being baled. As the baler is making a bale using the process of compaction, the wire tier will be pre-making the straps and placing them in the valley of each of the corkscrews 205, 210, 215, and 220, as shown. Again, the delivery method of placing these straps is determined by the speed of the motor that is coupled to the corkscrews 205, 210, 215, and 220. The speed of the motor is determined by the linear speed of the ejector on the baler as well as the programmed placement of the strap position and quantity.

An additional embodiment would allow the bale chamber 120 to expand in the case of an oversized bale, which can be common. More detail is provided with reference to FIG. 13 below. In this case, the pre-made straps would be driven off the chamber and discarded so that the chamber can be mechanically widened for the oversized bale. In some embodiments, the corkscrews 205, 210, 215, and 220 can be driven by a hydraulic, electric, air, etc. motor with the rotations being continuously monitored and driven by a controller. Each bale will have a predetermined set of variables for dimensional placement as well as number of straps. Each corkscrew 205, 210, 215, and/or 220 can be driven independently with multiple motors or through a connected chain, belt, or shaft driven device. It should be appreciated that a control system, such as those disclosed herein, may operate and control the corkscrews and/or one or more motors to adjust the speed at which the corkscrews rotate, thus adjusting the speed of the straps or wires as they traverse the length of the corkscrews.

Figure 11:
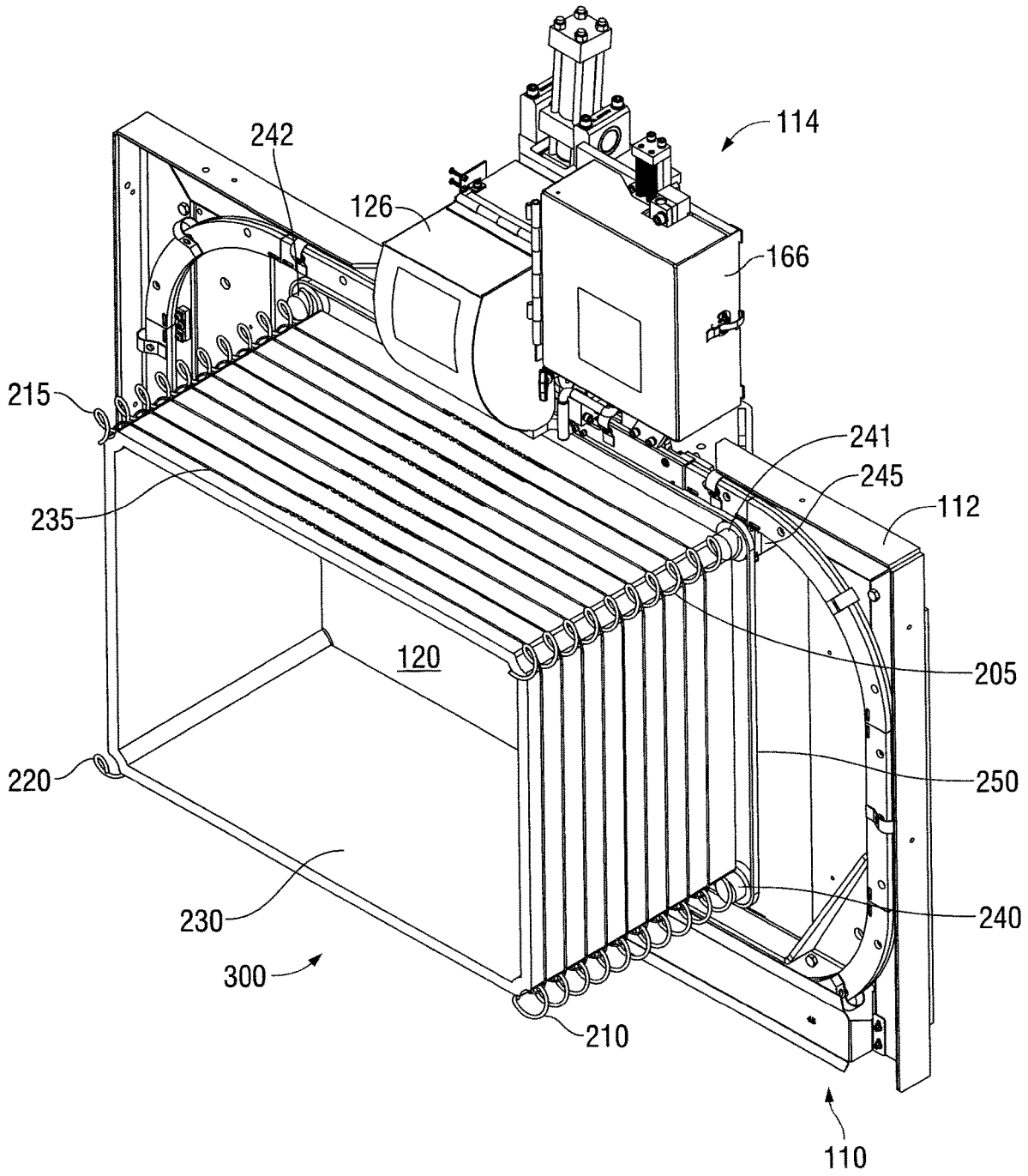
FIG. 11 is a perspective view of one embodiment of the strapper and multistrapping embodiment of the invention.

With reference now to FIG. 11, an embodiment of a strapping machine 110 may include a strapping machine frame 112. The exemplary strapping machine 110 also includes a knotter assembly 126 such as the knotter assembly described in one or more of the following U.S. patent applications: U.S. application Ser. No. 12/717,616, filed Mar. 4, 2010, entitled "Knotter Assembly,", now U.S. Pat. No. 8,397,632, issued Mar. 19, 2013; U.S. application Ser. No. 13/220,798, filed Aug. 30, 2011, entitled "Knotter Assembly,"; and U.S. application Ser. No. 13/753,188, filed Jan. 29, 2013, entitled "Method For Removing A Twist-Module Sub-Assembly In A Knotter Assembly,", the disclosure of each of which is hereby incorporated by reference in its entirety.

Figure 12:
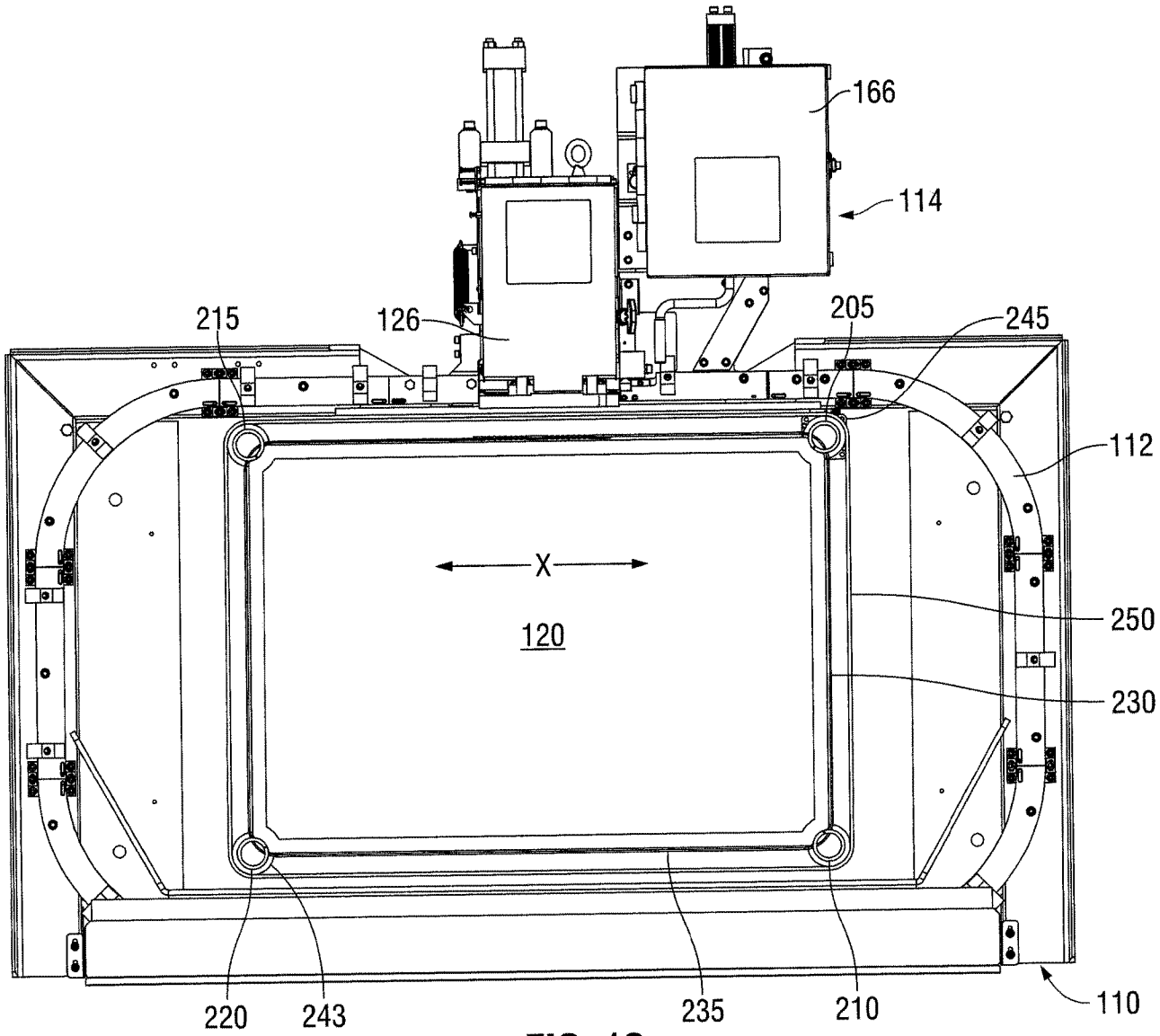
FIG. 12 is a back view of one embodiment of the strapper and multistrapping embodiment of the invention.

FIG. 11 is a front perspective view of one embodiment of the strapper and multistrapping embodiment of the invention; and FIG. 12 is a back view of one embodiment of the strapper and multistrapping embodiment of the invention.

Figure 13:
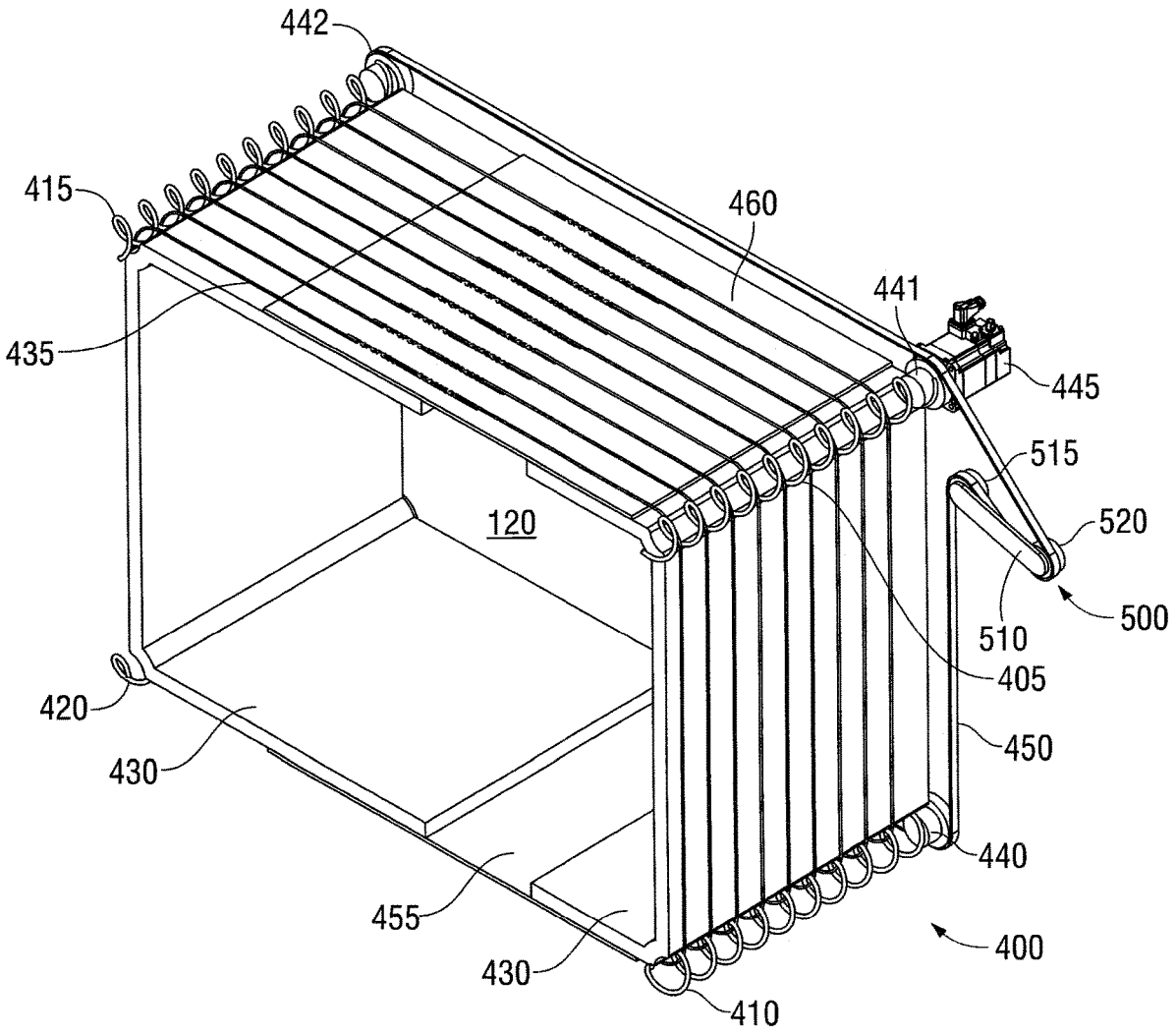
FIG. 13 is a perspective view of one embodiment of the strapper and multistrapping embodiment of the invention depicting an expanding and contracting chute for varying sized bales.

FIG. 13 is a front perspective view of one embodiment of the strapper and multistrapping embodiment of the invention comprising an expanding and contracting bale chute. With reference now to FIG. 13, as shown is one embodiment of the multistrapper 400. As shown, multistrapper 400 has an interior 120. In this embodiment, interior 120 comprises dimensional variability depending on the size of the bales to be made and/or the end user's needs. In many embodiments, multistrapper 400 can be comprised of metal, plastic or materials as used in the art of baling. Multistrapper 400 also includes bale chamber or bale chute 430 in which baled materials will progress forward for strapping when the device is in use. Some embodiments, such as that shown in FIG. 13, enable the expansion and contraction of the bale chamber 430. Expansion and contraction of the bale chamber 430 is advantageous due to the varying size of material that may travel through bale chute 430. It should be appreciated that the expansion and contraction may occur along either or both the x or y axis. Plates 455 and 460 may be used to provide rigidity and structure as bale chute 430 expands or contracts along an axis of travel. Additionally, plate 455 and 460 can minimize or prevent material from falling through the separate portions of the bale chute 430 as it expands and contracts to accommodate varying sizes of materials forming the bales traversing the bale chute 430.

In some embodiments, further illustrated are corkscrews 405, 410, 415, and 420 which are in mechanical communication with the exterior of multistrapper 400. As illustrated, in some embodiments, the corkscrews 405, 410, 415, and 420 are securely held onto the multistrapper 400 via straps or ties 435 which encircle the multistrapper 400 and are previously created by a strapping or tying machine, such as the ones disclosed throughout this application. By way of example, as the baler is making a bale using the process of compaction, a wire tier, or plastic strapper, will be pre-making the straps and placing them in a valley of each of the corkscrews as shown. The strap and wire tie creation has been previously disclosed in this application.

In several embodiments of the present invention, the delivery method of placing these straps 435 is determined by the speed of a motor 445 that is coupled to a drive band 450. It should be appreciated that drive band 450 may comprise a band, chain, or belt. The speed of the motor 445 is determined by the linear speed of the ejector on the baler as well as the programmed placement of the strap 435 position and quantity. In some embodiments of the present invention, the drive band 450 can rotate about wheels, pulleys, or cogs 440, 441, 442, and/or 443 (443 not shown in FIG. 13, but similarly depicted as 243 in FIG. 12). An additional design would allow the bale chamber 120 to expand in the case of an oversized bale, which can be common. In this case, the pre-made straps would be driven off the chamber and discarded so that the chamber can be mechanically widened for the oversized bale. In some embodiments, the corkscrews 405, 410, 415, and 420 can be driven by a hydraulic, electric, air, etc. motor with the rotations being continuously monitored and driven by a controller. Each bale will have a predetermined recipe for dimensional placement as well as number of straps 435. Each corkscrew 405, 410, 415, and/or 420 can be driven independently with multiple motors or through a connected chain, belt, or shaft driven device, such as drive band 450. Some embodiments, such as the embodiment shown in FIG. 13, may include a tensioning mechanism 500, comprising arm 510 and wheels, pulleys, or cogs 515 and 520. As depicted, and as would be appreciated by those with skill in the art, when arm 510 is rotationally adjusted to provide various positions of wheels, pulleys, or cogs 515 and 520 in relation to each other, tension may be added or relaxed on drive band 450. The incorporation of such a tensioning mechanism 500 is advantageous in conjunction with the expansion and contraction of bale chute 430. As a varying sized bale is introduced to bale chute 430, bale chute 430 may expand or contract to accommodate the varying sized bale. As bale chute 430 expands or contracts, a corresponding adjustment is made to tensioning mechanism 500, such that pulleys, wheels, or cogs 515 and 520 vary their positions relative to each other to provide more or less tension to drive belt 450. Additionally, it should be appreciated that as more or less tension is applied to drive belt 450 via tensioning mechanism 500 and as bale chute 430 expands or contracts, a corresponding movement is made to corkscrews 405, 410, 415, and 420 to allow the corkscrews to travel across one or more axis.

It should be appreciated that in some embodiments with a fixed size bale chute or an expanding and contracting bale chute as a bale exits the bale chute and as or after the strap or wire is placed onto the bale, the bale may expand in size as it is no longer compressed by the bale chute. In some embodiments, the expansion of the bale allows for the strap or wire to not be overly tight, as the expansion of the bale will fill the inner area formed by the strap or wire and providing a secure binding of the bale from further expansion while maintaining the overall structure of the bale.

In some embodiments, the present invention is a bale strapper for strapping of multiple straps on a bale comprising: a bale chute with a hollow interior and an exterior with edges; multiple corkscrews, with central axis, arranged around the exterior edges of said bale chute; a motor; a drive belt in mechanical communication with said multiple corkscrews; said motor is in mechanical communication with said drive belt; wherein when said motor is activated, said drive belt rotates about said motor causing said corkscrews to rotate about their central axis. In some embodiments, said bale strapper is mechanically attached to a combination strapping machine for tying wire or plastic straps. In some embodiments, said combination machine can form a plastic strap and extrude it onto a valley of each of said multiple corkscrews. In some embodiments, the rotation of said corkscrews will release said plastic strap onto a bale. In some embodiments, said combination machine can form a wire tie and extrude it onto a valley of each of said multiple corkscrews. In some embodiments, the rotation of said corkscrews will release said wire tie onto a bale. In some embodiments, said bale strapper is mechanically attached to a wire tying machine. In some embodiments, said combination machine can form a wire tie and extrude it onto a valley of each of said multiple corkscrews. In some embodiments, the rotation of said corkscrews will release said wire tie onto a bale. In some embodiments, said bale strapper is mechanically attached to a plastic strapping machine. In some embodiments, said combination machine can form a plastic strap and extrude it onto a valley of each of said multiple corkscrews. In some embodiments, the rotation of said corkscrews will release said plastic tie onto a bale. In some embodiments, the chute is capable of expanding and contracting across one or more dimensions to accommodate varying sized bales as the bale traverses and exits the chute.

From the foregoing, it will be seen that this invention is one well adapted to attain all the ends and objects hereinabove set forth together with other advantages, which are obvious and inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense. It should be appreciated that any dimensions or sizes described herein may be varied or adjusted for different applications of the present invention.

The invention claimed is:

1. A bale strapper for strapping of multiple straps on a bale comprising:

a bale chute comprising an exterior with edges and a hollow interior for receiving material for baling;

multiple corkscrews, each of said multiple corkscrews having a central axis extended along a length of the exterior of said bale chute, said multiple corkscrews are arranged around the exterior edges of said bale chute;

a motor;

a drive belt in mechanical communication with said multiple corkscrews;

said motor is in mechanical communication with said drive belt;

wherein when said motor is activated, said drive belt rotates about said motor causing said corkscrews to rotate about their central axis to release multiple straps onto a bale.

2. The bale strapper of claim 1, wherein said bale chute is attached to a combination strapping machine for tying wire or plastic straps.

3. The bale strapper of claim 2, wherein said combination strapping machine can form a plastic strap and extrude said plastic strap onto a valley of each of said multiple corkscrews.

4. The bale strapper of claim 3, wherein the rotation of said corkscrews will release said plastic strap onto a bale.

5. The bale strapper of claim 2, wherein said combination strapping machine can form a wire tie and extrude said wire tie onto a valley of each of said multiple corkscrews.

6. The bale strapper of claim 5, wherein the rotation of said corkscrews will release said wire tie onto a bale.

7. The bale strapper of claim 1, wherein said bale chute is attached to a wire tying machine.

8. The bale strapper of claim 7, wherein said wire tying machine can form a wire tie and extrude said wire tie onto a valley of each of said multiple corkscrews.

9. The bale strapper of claim 8, wherein the rotation of said corkscrews will release said wire tie onto a bale.

10. The bale strapper of claim 1, wherein said bale chute is attached to a plastic strapping machine.

11. The bale strapper of claim 10, wherein said plastic strapping machine can form a plastic strap and extrude said plastic strap onto a valley of each of said multiple corkscrews.

12. The bale strapper of claim 11, wherein the rotation of said corkscrews will release said plastic strap onto a bale.

13. The bale strapper of claim 1, wherein the bale chute is an expanding bale chute.

14. A method of operating a multistrapper baling machine comprising the steps of:

making a first strap;

depositing the first strap into a valley formed on each of a plurality of corkscrews arranged around an exterior of a bale chute;

rotating the plurality of corkscrews to advance the first strap along a length of each of the plurality of corkscrews;

making a second strap;

depositing the second strap into the valley formed on each of the plurality of corkscrews;

receiving material for baling into the baling chute;

advancing the received material through the baling chute;

depositing the first strap from the corkscrews onto a first portion of the received material as the first portion of the received material exits the baling chute;

advancing the received material through the baling chute; and depositing the second strap from the corkscrews onto a second portion of the received material as the second portion of the received material exits the baling chute.

15. The method of claim 14, wherein the received material moves at a speed equal to a speed of the advancing strap.

16. The method of claim 14, wherein the making the first strap and the making the second strap comprise a strapping machine forming a first plastic strap and a second plastic strap.

17. The method of claim 14, wherein the making the first strap and the making the second strap comprise a wire tying machine forming a first wire tie and a second wire tie.

18. The method of claim 14, wherein the receiving material for baling into the bale chute further comprises expanding the bale chute in one or more axis of travel.

* * * * *